US007950172B1

(12) United States Patent
Lewis

(10) Patent No.: US 7,950,172 B1
(45) Date of Patent: May 31, 2011

(54) VEHICLE IDENTIFICATION CARD WITH ADHESIVE FASTNER

(75) Inventor: Mark W. Lewis, Greenville, SC (US)

(73) Assignee: Marjen, Inc., Greenville, SC (US)

( * ) Notice: Subject to any disclaimer, the term of this patent is extended or adjusted under 35 U.S.C. 154(b) by 234 days.

(21) Appl. No.: 12/267,890

(22) Filed: Nov. 10, 2008

(51) Int. Cl.
*B65D 27/00* (2006.01)

(52) U.S. Cl. ..... 40/360; 40/634; 40/445; 40/593; 40/124.09; 40/594

(58) Field of Classification Search ..... 40/124.09, 40/360, 445, 492, 593, 594, 634, 661.09, 40/674, 638, 672; 283/81
See application file for complete search history.

(56) References Cited

U.S. PATENT DOCUMENTS 2,859,051 A * 11/1958 Simpson ..... 281/16
3,016,639 A * 1/1962 Kennedy et al. ..... 40/669
3,774,328 A * 11/1973 Tanney ..... 40/661.09
3,973,453 A * 8/1976 Tameo ..... 83/30
4,270,291 A * 6/1981 Babberl ..... 40/594
4,726,131 A * 2/1988 Cass ..... 40/638
5,230,174 A * 7/1993 Reed ..... 40/492
6,228,451 B1 * 5/2001 Boudouris et al. ..... 428/40.1
6,408,553 B1 * 6/2002 Brown et al. ..... 40/661.03
7,249,432 B2 * 7/2007 Lewis ..... 40/673
7,591,096 B2 * 9/2009 Krinke et al. ..... 40/593

* cited by examiner

*Primary Examiner* — Joanne Silbermann
*Assistant Examiner* — Christopher E Veraa
(74) *Attorney, Agent, or Firm* — John B Hardaway, III; Nexsen Pruet

(57) ABSTRACT

A vehicle identification card has the words SERVICE and READY on its front and rear sides, respectively, and includes a top segment having a horizontal band of static cling vinyl covered by a removable protective liner. Upon removal of the protective liner, the card can be adhered to the inside of a vehicle windshield with the word SERVICE visible from outside the vehicle and the top segment may be folded 180 degrees and adhered to the inside of the vehicle windshield with the word READY visible from outside the vehicle. The card is preferably a two section card with the before mentioned construction in an upper section and having a lower section which includes a removable key tag and a removable vehicle claim ticket. Service personnel can place the card on, and remove the card from, the inside of the vehicle windshield without bodily entering the vehicle.

8 Claims, 3 Drawing Sheets

VEHICLE IDENTIFICATION CARD WITH ADHESIVE FASTNER

BACKGROUND OF THE INVENTION

Businesses concerned with parking or servicing vehicles need to correlate the ignition key with the vehicle and place a notice on the vehicle as to whether or not it has been serviced, if that is nature of the business. Vehicle identification cards have been developed in an attempt to satisfy the beforementioned need including a card having a removable upper section carrying a matching vehicle identification number on both sides and the words SERVICE and READY on opposite sides. The previously marketed card has a punched out hole and a slit from the hole to the upper edge of the card which permits the upper section to be hung on the rear view mirror support of the vehicle with either the words READY or SERVICE being visible from outside the vehicle. Such cards are shown in applicant's U.S. Pat. No. 7,249,432 issued Jul. 31, 2007 for a Vehicle Locator and Identification Card and U.S. Pat. No. 7,373,749 issued May 20, 2008 for a Vehicle Identification Card with Removable Key Tag. Some vehicle manufacturers have changed the rear view mounting bracket to such an extent that the upper section of the identification card can no longer be connected to the rear view mirror support bracket. Thus there exists a need for a different design to permit reversible mounting of the upper section of the vehicle identification card in the vehicle with visibility of the SERVICE or READY status from outside the vehicle, which does not mount on the rear view mirror bracket. Heretofore, vehicle identification cards have been provided which have three separate sections, namely; one for mounting in the vehicle, a customer claim check and vehicle key tag section. There exists a need to reduce costs, yet still meet the needs of the businesses utilizing the card.

BRIEF DESCRIPTION OF THE INVENTION

The vehicle identification card has two sections defined by horizontal lines of perforations or cuts to permit separation. Each section carries the same vehicle identification number. The upper section includes the word SERVICE on one side, the word READY on the other side and is designed for placement on the inside surface of the front windshield of the vehicle. The upper section of the vehicle identification card includes an upper horizontal line of perforations defining a relatively narrow foldable top segment to which a strip of static cling vinyl is applied with adhesive. The vinyl strip is covered by a removable protective liner. When the protective liner is removed, exposing the static cling vinyl, the upper section of the vehicle identification card can be adhered to the inside of the vehicle windshield by pressing the strip of static cling vinyl to the vehicle windshield with the word SERVICE visible from outside the vehicle. After the vehicle is serviced, the upper section is removed from the windshield, the relatively narrow top segment is folded over on the upper horizontal line of perforations and then the upper section is placed against the inside of the windshield with the word READY visible from outside the vehicle. Thus, a single band of status cling vinyl is used for mounting the upper section of the service card in the SERVICE and READY positions on the inside of the vehicle windshield. Sunburst cuts are used, in place of an annular cut, to form an opening in the tail of the vehicle key tag and the locking slit on the key tag is formed without fragments of card material becoming separated from the card. The removable lower section of the vehicle identification card includes a vehicle key tag and a customer claim ticket, thus combining the two last mentioned features in the second or lower section and eliminating the need for a third card section.

BRIEF DESCRIPTION OF THE DRAWINGS

One embodiment of the invention is shown in the accompanying drawings, in which.

DETAILED DESCRIPTION OF THE DRAWINGS

Figure 1:
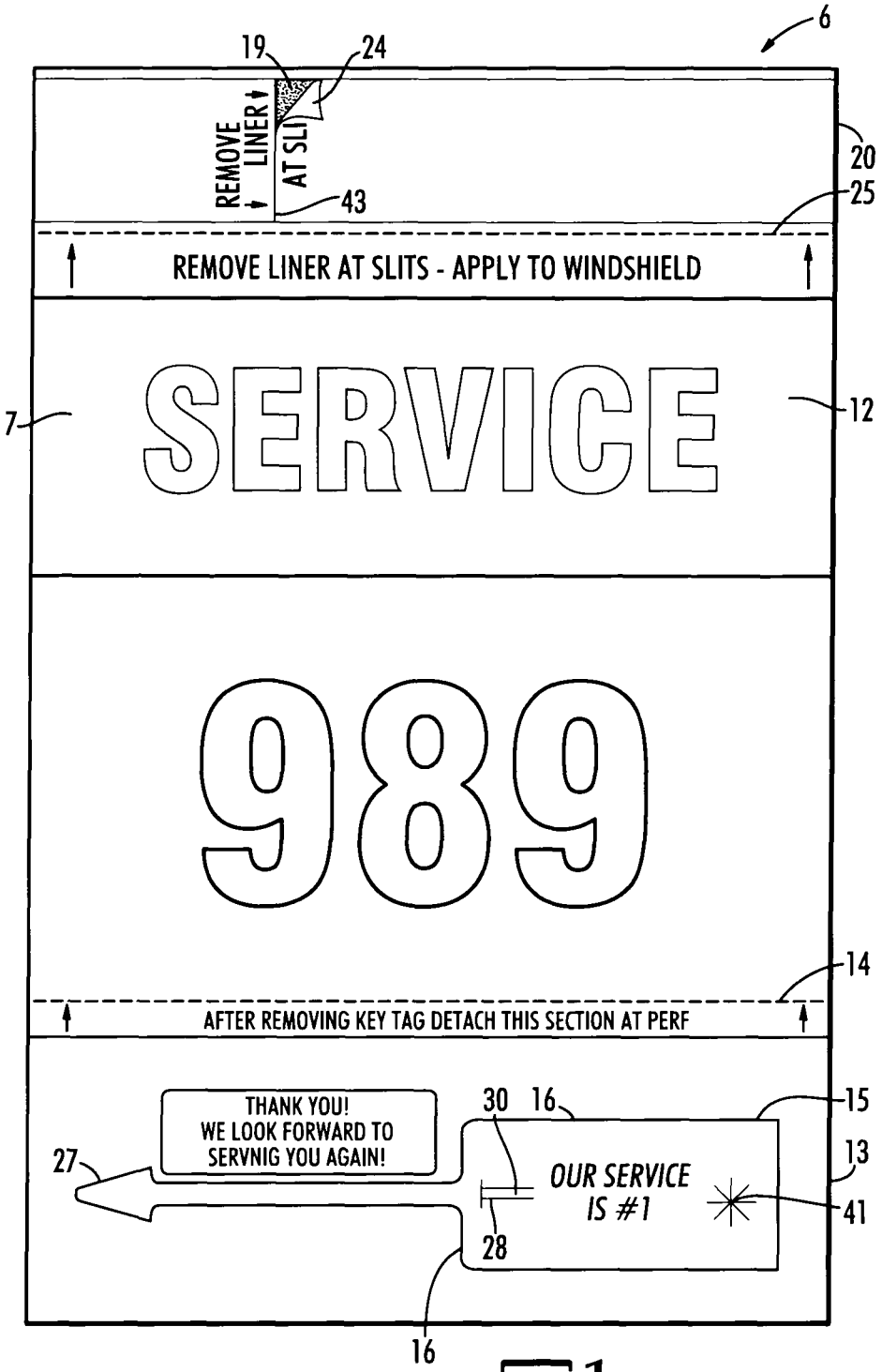
FIG. 1 is a view of the SERVICE side of the vehicle identification card of this invention.
Figure 2:
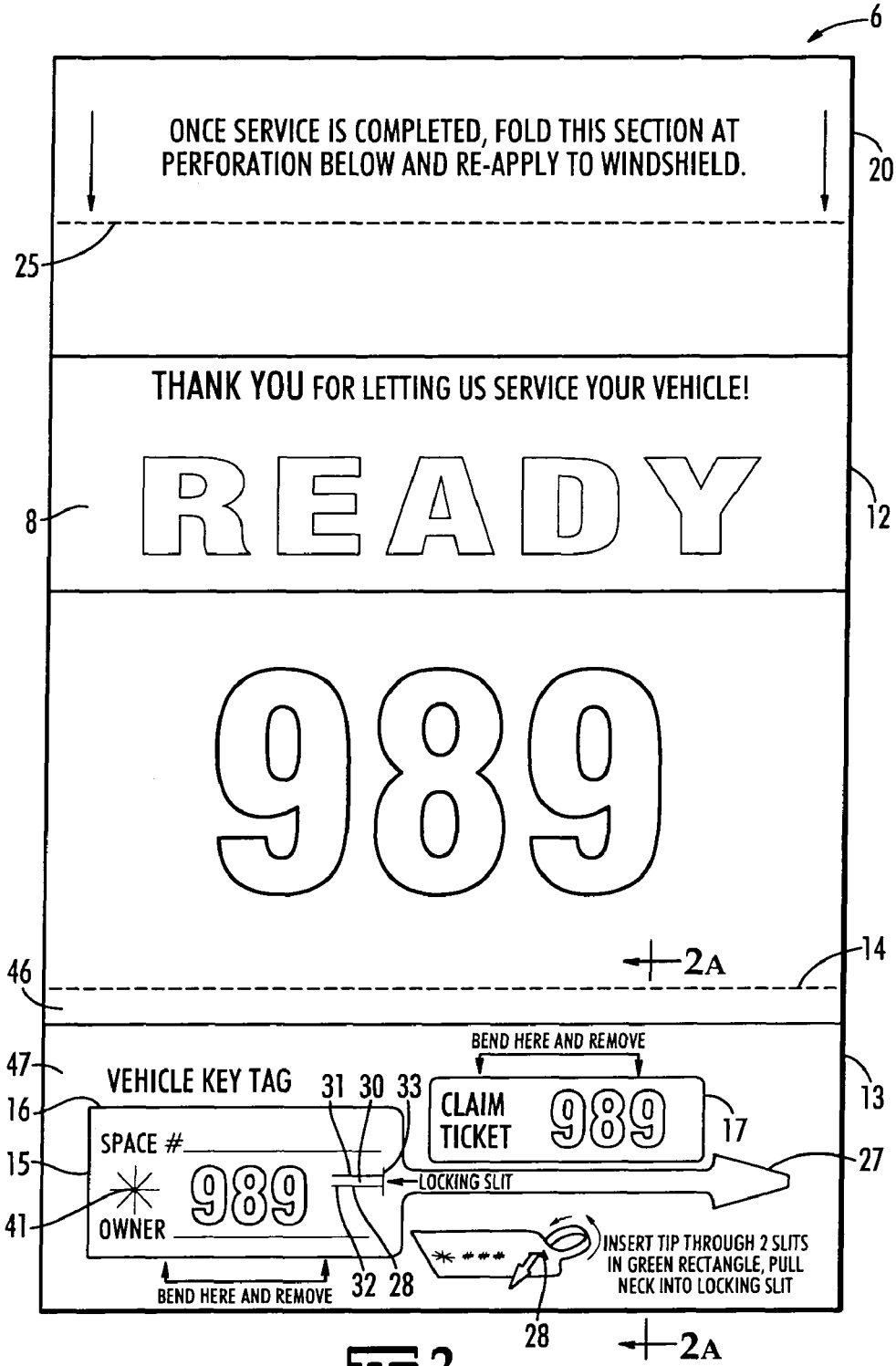
FIG. 2 is a view of the reverse or READY side of the card shown in FIG. 1.
Figure 2A:
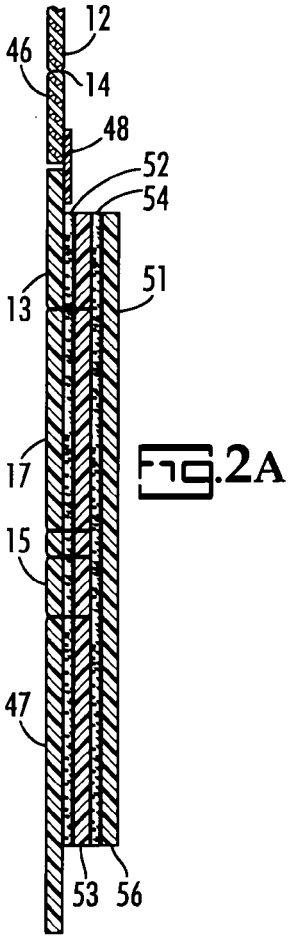
FIG. 2A is a section taken on the line 2A-2A in FIG. 2.
Figure 4:
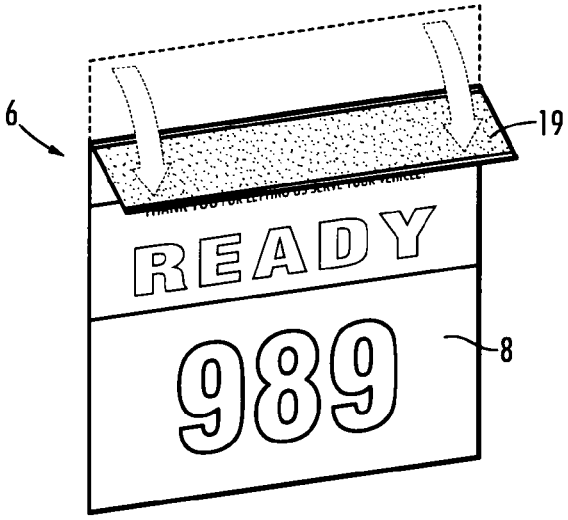
FIG. 4 shows the upper section of the vehicle identification card reversed with the upper segment containing the static cling vinyl folded over in preparation for application to the inside of the vehicle windshield.
Figure 5:
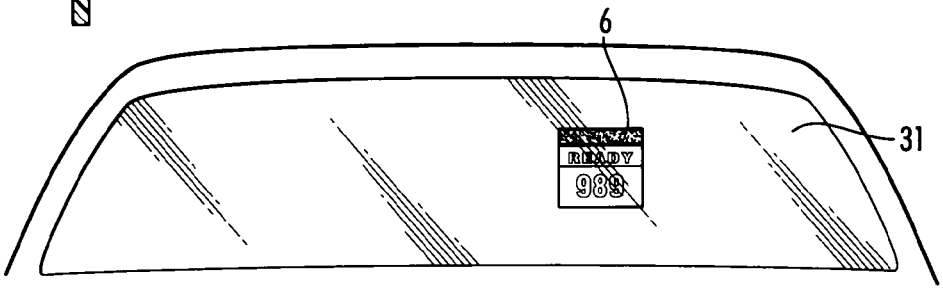
FIG. 5 shows the upper section of the vehicle identification card adhered to the inside surface on the vehicle windshield with the word READY showing through the windshield.

The vehicle identification card 6 shown in FIGS. 1 and 2 is made of a suitable paper board and includes an upper section 12 and a lower section 13 separated by a horizontal line of perforations 14, which facilitates manual separation of the sections 12 and 13. The upper section 12 carries the vehicle identification number 989 on and its front or SERVICE side 7 and on its rear or READY side 8. As shown in FIG. 2, the vehicle identification number is also printed on the tail 16 of a removable arrow shaped key tag 15 and on a claim ticket 17. Referring to FIG. 2A, the lower section includes a narrow band 46 of paper board below the line of perforations 14 and a synthetic paper portion 47 secured to the band 46 in an end to end relationship by an adhesive tape 48. A dry release laminate patch 51 has an adhesive layer 52, a plastic layer 53, a clean release adhesive layer 54 and a thin protective layer of plastic 56. After removal of a protective layer, not shown, from its cover of the adhesive layer 52 the patch 51 is affixed to the synthetic paper portion 47 thereby greatly reinforcing the key tag 15 and the claim ticket 17 which are die cut through the synthetic paper portion 47 and the plastic layer 53.

Figure 3:
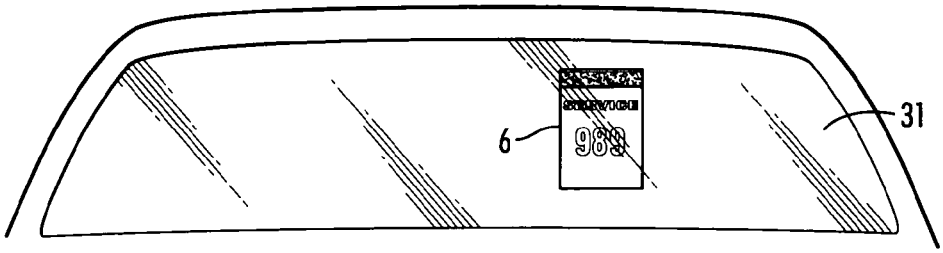
FIG. 3 is a front view of a vehicle windshield showing the top portion of the vehicle identification card adhered to the inside of a vehicle windshield with the word SERVICE showing through the windshield.

After the lower section 13 is removed, the upper section 12 is prepared for placement on the inside of the vehicle windshield 31 by removal of a thin pliable protective liner 24, covering a band 19 of static cling vinyl extending across and bonded to the top segment 20 of the upper section 12. A vertically extending cut 43 is made in the protective liner 24 to facilitate its removal. A horizontal line of perforations 25 extend across the top part of the upper card section 12 to facilitate folding of the top segment 20. After the thin pliable protective liner 24 is removed from the upper section 12, it may then be adhered to the inside of the windshield 31 of a vehicle as shown in FIG. 3 and the word SERVICE and the vehicle identification number will be visible to service personnel outside of the vehicle.

The parking space number and the vehicle owner's name are entered on the tail 16 of the vehicle key tag 15 once the key tag 15 is removed from the lower section 13. The claim ticket 17 is then given to the vehicle owner. The head 27 of the key tag 15 is passed through the opening in an ignition key or a ring to which the ignition key is connected. The head 27 is then passed through an opening or slot 28 formed when a tab 30, defined by two parallel cuts 31, 32 and a cross cut 33 at the ends of the cuts 31, 32, is bent to expose the slot 28. FIG. 2 shows the head 27 of the arrow 15 passed through the slot 28. The tab 30 remains hinged to the arrow 15. A star burst type opening 41 is formed by crossing slits cut through the tail 16 of the arrow 15. The star burst opening 41 permits the key tag 15 to be hung on a peg or nail, not shown. Theretofore, the cuts forming a slot for insertion of the head 27 of the key tag 15 and a hole for hanging the key tag 15 produced bits of loose rectangular and annual paper board material that tended to interfere with proper operation of the machinery producing a vehicle identification card. The disclosed construction avoids that problem.

After the vehicle is serviced, the upper section 12 of the vehicle identification card 6 is removed from the windshield 31, the top segment 20 is folded 180 degrees on the line of perforations 25, and then the upper section is reversed and the top segment 20 with its exposed band of static cling vinyl 19 is placed against the inside of the windshield, thereby displaying the word READY to personnel outside of the vehicle. Folding the top segment 20 does not obscure the vehicle identification number and the word READY.

Although several repositionable adhesives may be suitable for releasably attaching the protective liner 24 to the static cling vinyl 19, an adhesive found suitable is a repositionable adhesive designated IN037 which is marketed by Strata-Tac Inc. of 1055 Kingstand Drive, Batavia, Ill. U.S.A.

The upper section 12 of the herein disclosed vehicle identification card 6 can be releasably secured to the inside of a vehicle windshield to display the SERVICE or READY status of the vehicle without the servicing person needing to actually enter the vehicle. In other words, the servicing person can open the vehicle door and apply, reverse or remove the upper section of the vehicle identification card while standing outside the vehicle. This eliminates possible soiling of the interior of the customer's vehicle by the servicing personnel. Although use of the invention is illustrated in a two section vehicle registration card; many of its features are advantageously useful when used in a three section vehicle identification card.

What is claimed is:

1. A vehicle identification card comprising:

a lower section including an ignition key tag with an identification number, and an upper section having a front side and a rear side both of which carry said identification number, said upper section being separated from said lower section by a first horizontal line of perforations permitting separation of said upper section from said lower section, said upper section having a horizontally extending band of static cling vinyl bonded to and extending across a top segment of said upper section, a second horizontal line of perforations immediately below said top segment permitting said top segment to be folded 180 degrees without obscuring said vehicle identification number on said upper section, and a thin removable protective liner of material on said band of static cling vinyl wherein said upper section includes the word "SERVICE" on its front side and the word "READY" on said rear side, and wherein said top segment does not obscure said word on the side towards which it is folded said 180°.

2. The vehicle identification card of claim 1 wherein said upper section of said card is attachable to the inside of a vehicle windshield when said protective liner is removed from said band of static cling vinyl.

3. The vehicle identification card of claim 1 wherein said band of static cling vinyl is on said front side of said vehicle identification card.

4. The vehicle identification card of claim 1 wherein said lower section includes a removable claim ticket carrying said vehicle identification number.

5. The vehicle identification card of claim 4 wherein said lower section includes serrations defining a removable arrow shaped key tag and said claim ticket.

6. The vehicle identification card of claim 5 wherein said arrow shaped key tag includes a tail having slits forming a star burst type opening.

7. The vehicle identification card of claim 6 including cuts in said tail forming a hinged flap which when open permits insertion of the head of said arrow shaped key tag.

8. The vehicle identification card of claim 1 wherein a band of clean release adhesive is on the back side of said lower section and said band of clean release adhesive is covered by a thin protective layer of plastic.

* * * * *